US009149113B2

(12) United States Patent
Andersson

(10) Patent No.: US 9,149,113 B2
(45) Date of Patent: Oct. 6, 2015

(54) PIECE OF FURNITURE

(75) Inventor: Benny Andersson, Almhult (SE)

(73) Assignee: IKEA Supply AG, Pratteln (CH)

( * ) Notice: Subject to any disclaimer, the term of this patent is extended or adjusted under 35 U.S.C. 154(b) by 0 days.

(21) Appl. No.: 14/354,724

(22) PCT Filed: Oct. 28, 2011

(86) PCT No.: PCT/EP2011/068981

§ 371 (c)(1),
(2), (4) Date: Apr. 28, 2014

(87) PCT Pub. No.: WO2013/060380

PCT Pub. Date: May 2, 2013

(65) Prior Publication Data

US 2014/0239785 A1 Aug. 28, 2014

(51) Int. Cl.
*A47G 29/00* (2006.01)
*A47B 47/05* (2006.01)

(52) U.S. Cl.
CPC ..... *A47B 47/05* (2013.01); *A47B 2230/06* (2013.01); *Y10T 29/49826* (2015.01)

(58) Field of Classification Search
CPC ..... A47B 47/03
USPC ..... 312/107, 108, 111, 257.1, 263, 265.5, 312/265.6
See application file for complete search history.

(56) References Cited

U.S. PATENT DOCUMENTS

| | | | | |
|---|---|---|---|---|
| 3,379,483 | A * | 4/1968 | Oldford | 312/263 |
| 3,730,605 | A | 5/1973 | Eckard | |
| 5,063,695 | A * | 11/1991 | Briscoe et al. | 37/451 |
| 7,641,414 | B1 * | 1/2010 | Joyce | 403/231 |
| 2003/0155847 | A1 * | 8/2003 | Henkel | 312/257.1 |
| 2010/0290831 | A1 | 11/2010 | Burnett et al. | |

FOREIGN PATENT DOCUMENTS

| | | |
|---|---|---|
| CN | 2815105 | 9/2006 |
| DE | 32 44 398 | 6/1984 |
| DE | 20315190 | 2/2004 |
| EP | 1097659 | 5/2001 |

OTHER PUBLICATIONS

International Search Report for International Application No. PCT/EP2011/068981 mailed May 30, 2012 (2 pages).

(Continued)

*Primary Examiner* — Matthew Ing
(74) *Attorney, Agent, or Firm* — Merchant & Gould P.C.

(57) ABSTRACT

A piece of furniture (1) has a first piece (4) attached to second and third pieces (2) being perpendicular to the first piece (4) and where two opposing edges (5) of the first piece (4) are attached to one of the second and third pieces (2) each. The edges (5) of the first piece (4) are received in a groove (10) of each of the second and third pieces (2), that the first piece (1) is perpendicular to the second and third pieces (2) and that the second and third pieces (2) are placed parallel to each other. The mounting of a back of a cupboard is made in that two opposing vertical edges of the back is received in a vertical groove each at the edge of two side pieces, which two side pieces are arranged at the two opposing vertical edges of the back.

13 Claims, 4 Drawing Sheets

(56) References Cited

OTHER PUBLICATIONS

International Preliminary Report on Patentability for International Application No. PCT/EP2011/068981 (11 pages).

Chinese Office Action for CN Application No. 201180074447.8 mailed Jun. 11, 2015 (11 pages).

* cited by examiner

PIECE OF FURNITURE

This application is a National Stage Application of PCT/EP2011/068981, filed 28 Oct. 2011, and which application is incorporated herein by reference. To the extent appropriate, a claim of priority is made to the above disclosed application.

TECHNICAL FIELD

The present invention concerns a piece of furniture. More particularly the invention concerns attachment of a sheet-like part to other parts of the piece of furniture. The invention also concerns a method of mounting a back of a cupboard.

BACKGROUND

In sale of different pieces of furniture it is common that the piece of furniture is delivered in a non assembled condition. The consumer is then to assemble the piece of furniture. In order to facilitate the assembling for the consumer it is beneficial if the mounting may be made in a simple but yet reliable way. If possible the way to assembly the piece of furniture should be more or less self-explaining. It is also positive if the piece of furniture can be assembled in only one way.

SUMMARY

One object of the present invention is to facilitate mounting of for instance a cupboard. A person skilled in the art realises that the mounting process of the present invention may be used for different parts of different types of furniture or the like.

According to one aspect of the present invention mounting of for instance a back to a cupboard is facilitated in that the back has only to be slid a short distance. Previously, often a back has been slid a distance corresponding with the height of the back.

The present invention has been developed for attaching a back to a cupboard. However, a person skilled in the art realises that the invention may be used also for many other types of furniture. Further objects and advantages of the present invention will become obvious to a person skilled in the art from reading the detailed description below of different embodiments.

BRIEF DESCRIPTION OF THE DRAWINGS

The invention will now be described further by way of examples and with reference to the enclosed drawings. In the drawings.

DETAILED DESCRIPTION

As used in this description the terms "vertical", "horizontal" and the like are in view of the piece of furniture in its normal position in use.

Even though the present invention is described as a back for a cupboard, a person skilled in the art realises that the invention may be used when attaching a first piece 4 to second and third pieces 2 being perpendicular to the first piece 4 and where two opposing edges of the first piece 4 are attached to one each of the second and third pieces. As one example of attaching a relative thin plate of a piece of furniture to other parts of the furniture, a cupboard 1 is shown in the Figs. as one example. The first piece corresponds with a back 4 of the cupboard 1 and the second and third pieces correspond with two side pieces 2 of the cupboard. The back 4 is to be attached between the side pieces 2.

Figure 1:
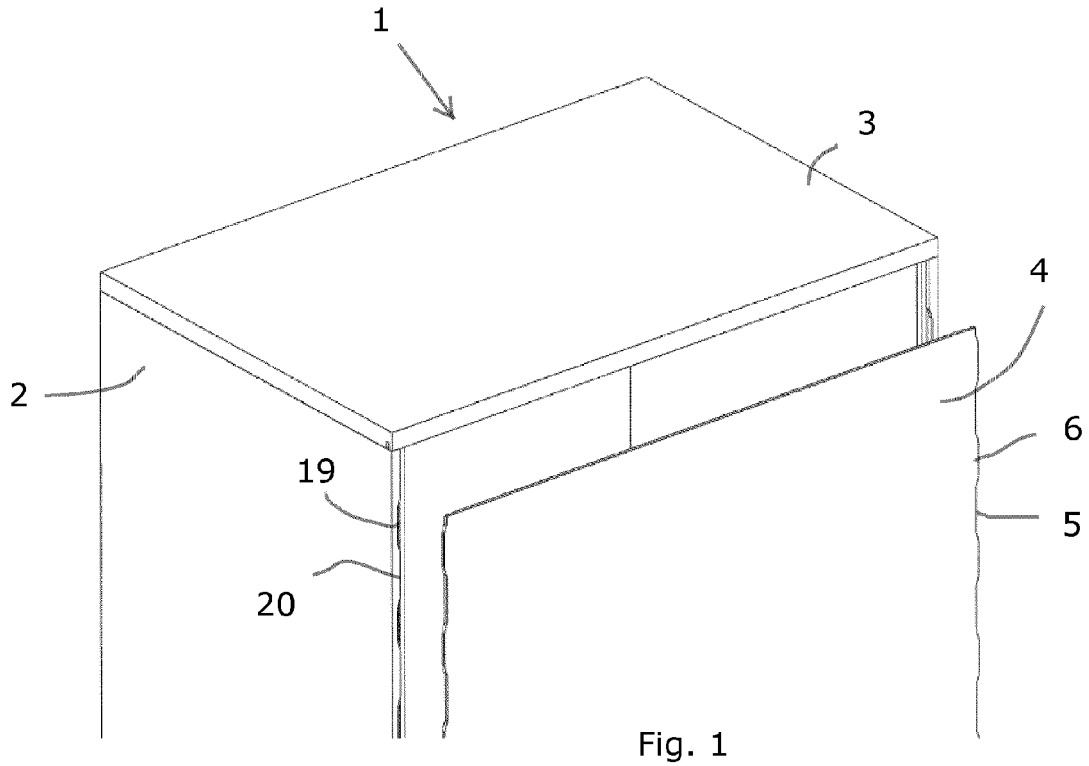
FIG. 1 is a perspective view of a cupboard, illustrating a back to be attached to the cupboard.
Figure 2:
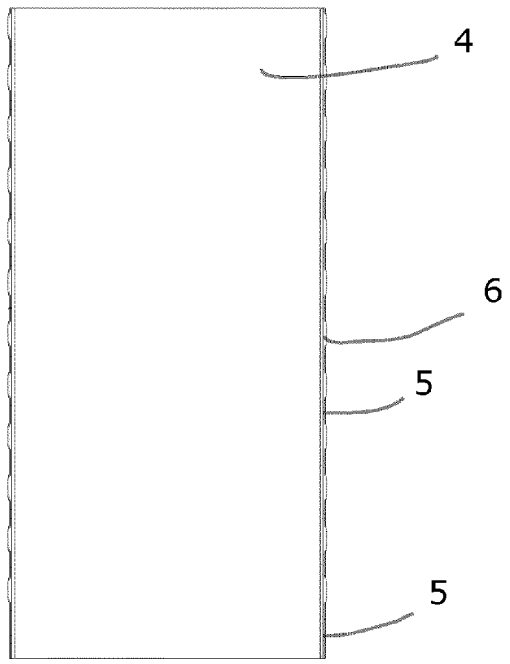
FIG. 2 is plan view of the back of FIG. 1.

Two opposing edges 5 of the back 4 are uneven in having a number of protruding parts 6 protruding outside respective edge 5. The protruding parts 6 are placed at an even distance from each other. As seen in FIG. 2 there are no protruding parts 6 at one end of the respective edge 5. The ends of the edges 5 having no protruding part 6 is to be placed at the bottom of the cupboard 1. The purpose of the protruding parts 6 will be described below.

The end of each side piece 2 facing backwards has an edge 19 and a number of protruding parts 20. The protruding parts 20 are directed inwards, i.e. towards the opposite side piece 2. Thus, the protruding parts 20 are parallel with the back 4. The purpose of the protruding parts 20 at one end of each side piece 2 will be described below.

Figure 9:
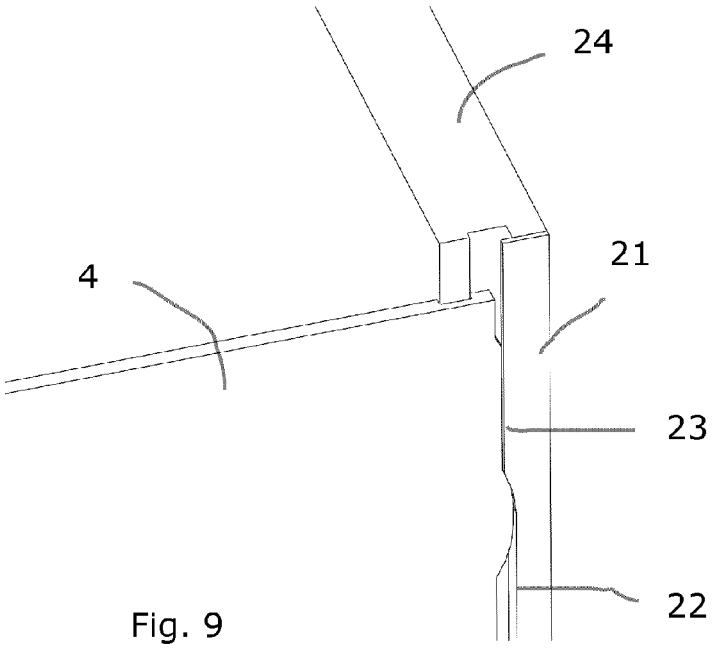
FIG. 9 is a view corresponding to FIG. 6 of an alternative embodiment.

In an alternative embodiment shown in FIG. 9, a strip 21 is placed at the end of a side piece 24. The strip 21 has an edge 22 and protruding parts 23, corresponding with the edge 19 and protruding parts 20 of each side piece 2, as described above. Thus, in this alternative embodiment the side piece 24 as such has no protruding parts, the protruding parts being arranged on the strip 21 in stead. In all other aspects the side piece 24 corresponds with the side pieces 2 described in connection with the first embodiment. The strip 21 is normally made of a plastic material, but a person skilled in the art realises that it could be made in other materials as well, such as wood. Even though in the further description below the alternative embodiment having strips 21 is not described explicitly, a person skilled in the art realises that the description applies correspondingly for the strips 21.

Each side piece 2 of the cupboard 1 has an inner side 9, to be facing the inside of the cupboard 1, and an opposing outer side 8. One end of each side piece 2 of the cupboard 1 is given a grooved form for receiving one end of the back 4. The cooperation between the side pieces 2 and the back 4 will be described further below.

Figure 3:
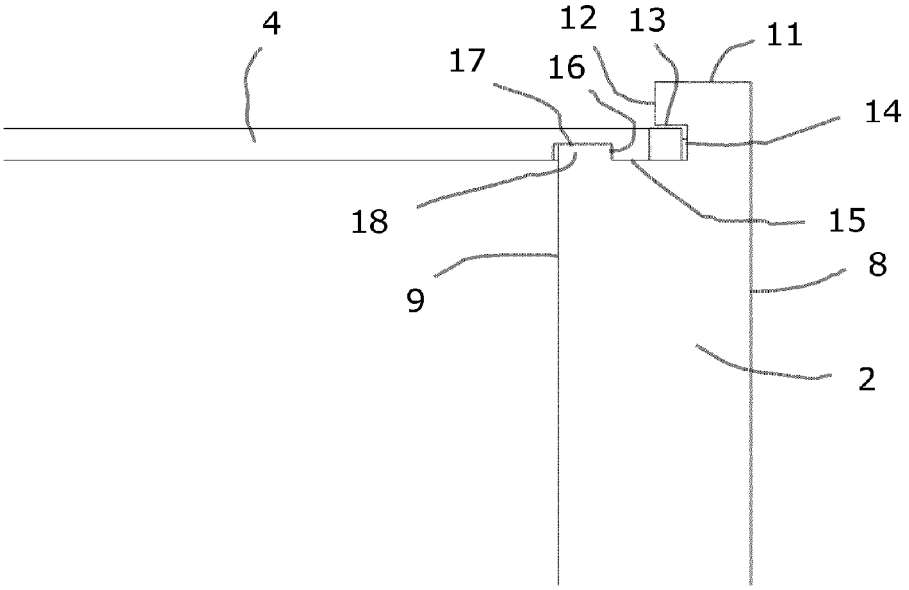
FIG. 3 is a view from above illustrating attachment of the back of FIGS. 1 and 2.
Figure 5:
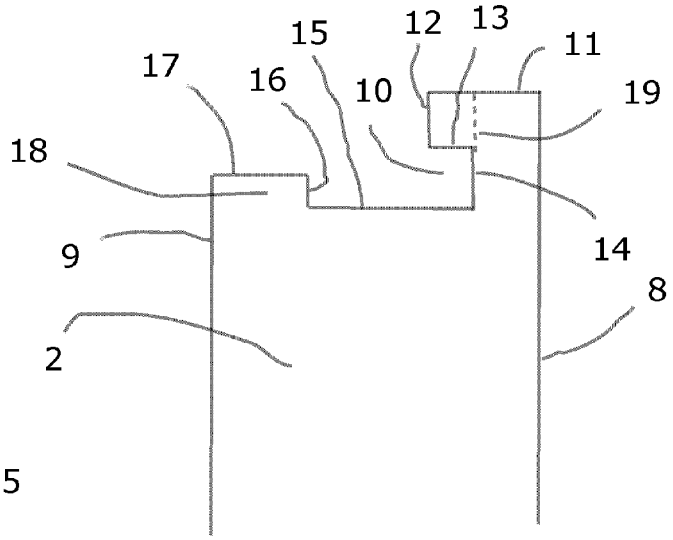
FIG. 5 is a view from above of one end area of one side piece of the cupboard of FIG. 1, FIGS. 6 to 8 schematically illustrate steps taken in attaching the back to the cupboard of FIG. 1.

As seen in view from above, and as shown particularly in FIG. 5, each side piece 2 of the cupboard 1 has a vertical groove 10 at one end for receiving one end of the back 4. The groove 10 extends the total height of the side piece 2. In the views of FIGS. 3 and 5 the form of the groove 10 is shown in the position of a protruding part 20 of the side piece 2. The groove 10 and adjacent parts are formed of a number of sides 12-17, where each side 12-17 is arranged perpendicularly to adjacent sides 12-17. An end side 11 of the side piece 2, placed at the groove 10, is perpendicular to the outer side 8 of the side piece 2 and said end side 11 extends along a part of the overall thickness of the side piece 2. The length of the end side 11 differs depending on if placed at a protruding part 20 or not. A first side 12 adjacent the groove 10 goes inwards, i.e. directed to the centre of the side piece 2, from the end side 11 and a second side 13 is directed towards the outer side 8 of the side piece 2. In the positions where there is no protruding part 20, i.e. where there is an edge 19, there is normally no second side 13. As the protruding parts 20 have inclined surfaces towards the edge 19, the extent of the second side 11 varies from no extent to the extent as shown in the Figs. A third side 14 is directed inwards and a fourth side 15 is directed towards the inner side 9 of the side piece 2. A fifth side 16 is directed outwards and a sixth side 17 adjacent the groove 10 is directed towards the inner side 9 of the side piece 2. The sixth side 17 ends at the inner side 9 of the side piece 2 and is perpendicular to the inner side 9 of the side piece 2. The first side 12 is followed by the second side 13 and so until the sixth side 17. The groove 10 as such is formed of the second side 13, the third side 14, the fifth side 15 and the sixth side 16. By means of the form of the groove 10 a vertical rail 18 is formed at the inner side 9 of the side piece 2 and adjacent each groove 10. The height of the rail 18 is a part of the thickness of the groove 10, as seen from above in FIGS. 3 and 5.

Figure 4:
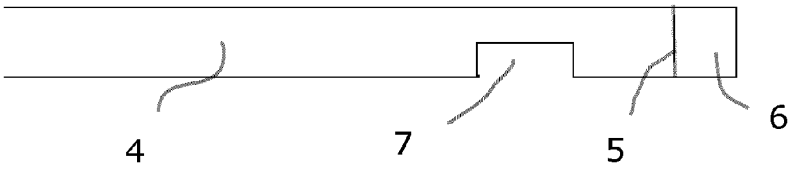
FIG. 4 is a view from above of a part of the back of FIGS. 1 and 2.

As seen in view from above, and as shown particularly in FIG. 4, the back 4 has a groove 7 at each side, which grooves 7 of the back 4 are to co-operate with the rail 18 of one side piece 2 each of the cupboard, as indicated in FIG. 3.

The protruding parts 20 on the edge 19 of each side piece 2 correspond with the first side 12 of the groove 10, as described in connection with FIGS. 3 and 5. In FIG. 5 the edge 19 of the side piece 2 is indicated by a dashed line. There is a protruding part 20 at the top of each edge 19 of each side piece 2, i.e. closest to the top 3 of the cupboard 1. The dimensions of the protruding parts 6 of the back 4 and the protruding parts 20 of the side pieces 2 are adapted to each other. Said adaptation is such that the protruding parts 6 of the back 4 may be received between the protruding parts 20 of the side pieces 2. Thus, the vertical length of each protruding part 6 of the back 4 is smaller than the vertical distance between two adjacent protruding parts 20 of the side pieces 2. Even though the protruding parts 6, 20 of the back 4 and the side pieces 2, respectively, are shown having an equal spacing, a person skilled in the art realises that uneven spacing may be used, as long as the uneven spacing is such that the protruding parts 6 of the back 4 may be received between corresponding protruding parts 20 of the side pieces 2.

The grooves 7 of the back 4 are to be placed surrounding the rails 18 of the side pieces 2. The grooves 10 of the side pieces 2 are to receive one edge 5 each of the back 4.

The horizontal distance between the outer edges of two protruding parts 6 at opposite edges 5 of the back 4 is smaller than the horizontal distance between the edges 19 of respective side piece 2, when the cupboard 1 is assembled. At the same time said horizontal distance between the outer edges of two protruding parts 6 at opposite edges 5 of the back 4 is larger than the horizontal distance between the outer edges of the protruding parts 20 at the edges of the side pieces 2, when the cupboard 1 is assembled.

The horizontal distance between the opposing edges 5 of the back 4 is smaller than the horizontal distance between the outer edges of the protruding parts 20 of the side pieces 2, when the cupboard is assembled. Thus, the protruding parts 6 of the back 4 and the protruding parts 20 of the side pieces 2 will be placed above each other when the cupboard 1 has been assembled. By means of the dimensions and said horizontal distances between respective protruding parts 6, 20 and respective edges 5, 19, the back 4 may be pushed in between the side pieces 2 with the protruding parts 5 of the back 4 placed between the protruding parts 20 of the side pieces 2.

Figure 6:
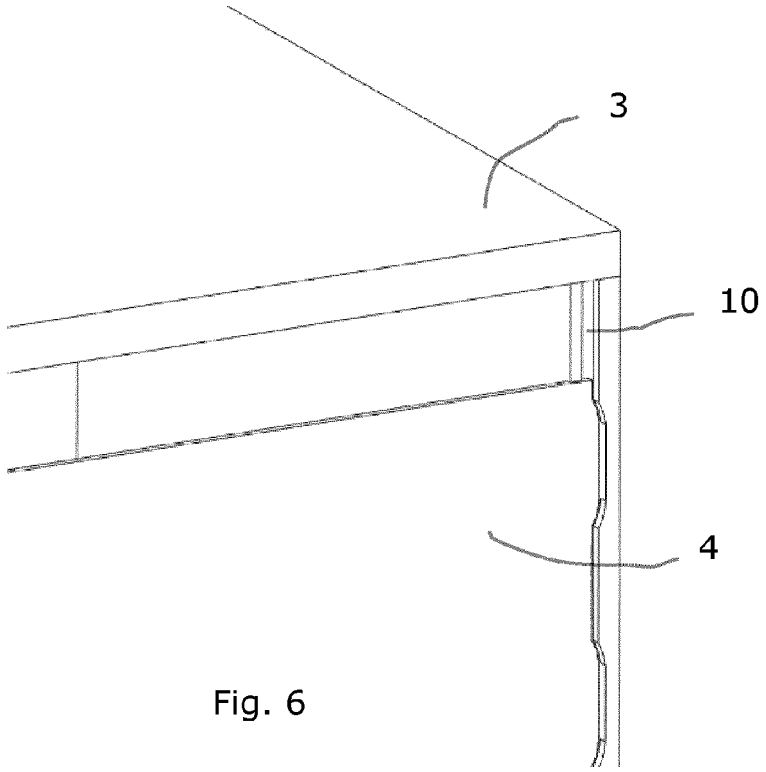
Figure 7:
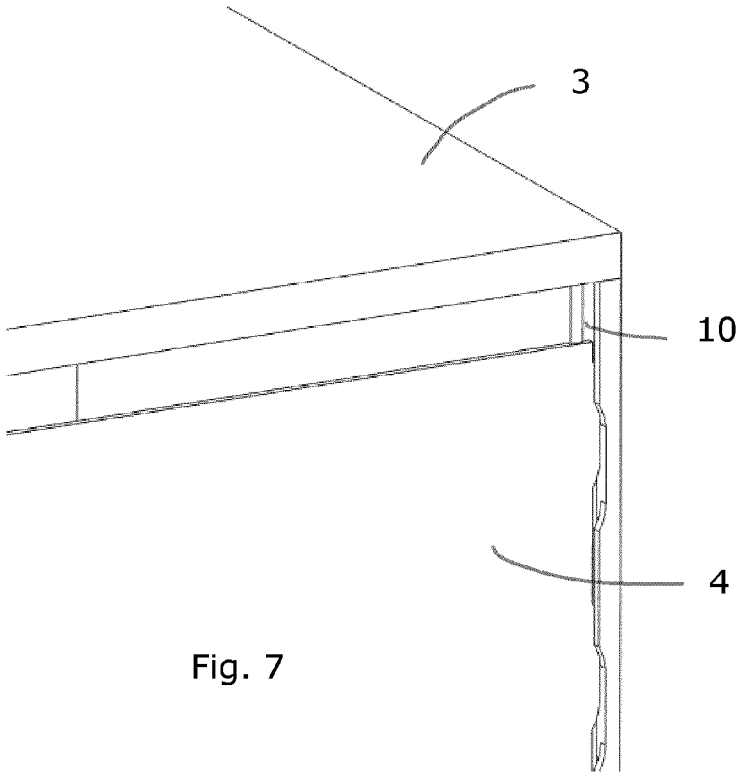
Figure 8:
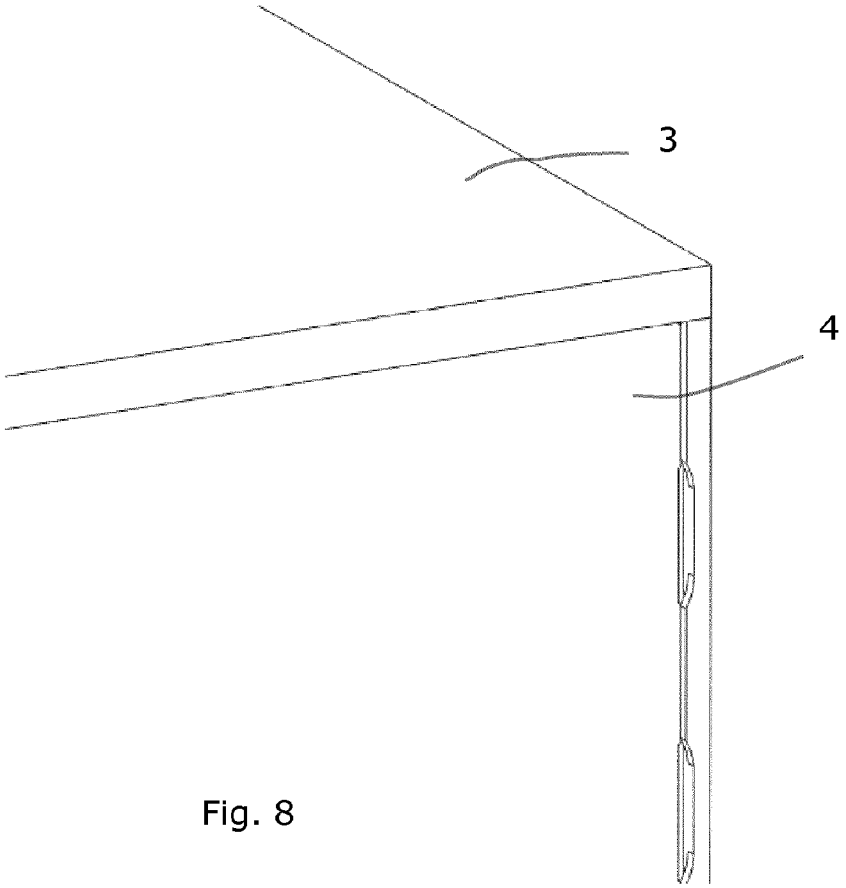

In FIGS. 6 to 8 the way the back 4 is fixed to the cupboard 1 is shown in an illustrating way. In FIG. 6 the back 4 is shown in the position when the back 4 is first placed in the grooves 10 of the side pieces 2. The back 4 is placed in the grooves 10 in that the protruding parts 6 of the back 4 is placed between two adjacent protruding parts 20 of the side pieces 2. With the back 4 placed in the grooves 10 of the side pieces 2, the rails 18 of the side pieces 2 are placed in the grooves 7 of the side pieces 2. The back 4 is then pushed upwards as shown in FIG. 7. The movement of the back 4 is guided by means of co-operation between the rails 18 of the side pieces 2 and the grooves 7 of the back 4 and also the edge 5 of the back 4 and the grooves 10 of the side pieces 2. The back 4 is pushed upwards until the upper edge of the back 4 abuts the top 3 of the cupboard 1. This final position of the back 4 is shown in FIG. 8. The back 4 is finally fixed to the cupboard 1 in the position shown in FIG. 8, in that nails or the like are driven in along the side pieces 2 and/or along a bottom of the cupboard 1. The nails are normally placed in the area between the protruding parts 20 at the edges of the side pieces 2.

The invention claimed is:

1. A piece of furniture comprising a first piece, a second piece, and a third piece, the first piece comprising two opposing edges attached to one of the second and third pieces each, wherein:

the opposing edges of the first piece are received in a groove of each of the second and third pieces, the first piece is perpendicular to the second and third pieces and the second and third pieces are parallel to each other, wherein a number of protruding parts are arranged at two opposing edges of the first piece, wherein the protruding parts of the first piece are constructed to slidingly engage with the grooves of the second and third pieces, a number of protruding parts are arranged at an edge at an end of each of the second and third pieces, and the vertical dimension of each protruding part of the first piece is smaller than the vertical distance between two protruding parts of the second and third pieces.

2. The piece of furniture of claim 1, wherein the first piece has a groove adjacent and parallel with each respective opposing edge, wherein the first piece is arranged displaceable in the grooves of the second and third pieces, wherein a rail is arranged at each of the second and third pieces, which rails are positioned inside the grooves of the first piece when the piece of furniture has been assembled, and wherein the rails are arranged at an inner side of each of the respective second and third pieces.

3. The piece of furniture of claim 1, wherein the protruding parts of the second and third pieces are integrated parts of the second and third pieces, made in one piece with the second and third pieces.

4. The piece of furniture of claim 1, wherein on each of the second and third pieces, protruding parts are arranged on a strip attached. to one end of each of the respective second and third pieces, which strip has an edge from which the protruding parts protrude.

5. The piece of furniture of claim 1, wherein the protruding parts at the edges of the first piece are placed at equal spacing and wherein on each edge of each of the second and third pieces the protruding parts are placed at equal spacing.

6. The piece of furniture of claim 5, wherein each edge of the first piece has an area with no protruding parts and wherein each edge of each of the second and third pieces has an area with no protruding parts.

7. The piece of furniture of claim 5, wherein each protruding part of the first piece has an outer edge protruding beyond the two opposing edges. and each protruding part of the second and third pieces has an outer edge, and wherein the horizontal distance between the outer edges of the protruding parts of the first piece is larger then the horizontal distance between the outer edges of the protruding parts of the second piece and the protruding parts of the third piece, and wherein the horizontal distance between the two opposing edges of the first piece is smaller than the horizontal distance between the outer edges of the protruding parts of the second and third pieces.

8. The piece of furniture of claim 1, wherein the first piece is a back and the second and third pieces are side pieces of a cupboard.

9. A method of mounting a back of the cupboard of claim 8, wherein the opposing edges of the back are vertical edges, and wherein each of the two opposing vertical edges of the back is received in a vertical groove at the edge of one of the two side pieces, which two side pieces are arranged at the two opposing vertical edges of the back, by placing the protruding parts at the two opposing edges of the back in an open area between protruding parts at the edge of each respective side piece and sliding the back in relation to the side pieces in a vertical direction in vertical rails and grooves of the side pieces and the back, respectively.

10. The method of claim 9, wherein the back is displaced until an upper edge of the back abuts a lower side of a top of the cupboard, whereby each protruding part of the opposing vertical edges of the back is placed beneath a protruding part at the edges of the side pieces.

11. The method of claim 10, wherein the back is fixed to the side pieces by means of nails placed in the area between the protruding parts at the edge of each side piece.

12. The piece of furniture of claim 1, wherein the groove on each of the second and third pieces is a unitary groove extending along a height of each of the second and third pieces.

13. The piece of furniture of claim 6, wherein the area with no protruding parts of the first piece is located adjacent at a bottom of each of the opposing edges of the first piece.

* * * * *